US010502155B2

(12) United States Patent
Toyohara et al.

(10) Patent No.: US 10,502,155 B2
(45) Date of Patent: Dec. 10, 2019

(54) CONTROL DEVICE FOR INTERNAL COMBUSTION ENGINE

(71) Applicant: Hitachi Automotive Systems, Ltd., Hitachinaka-shi, Ibaraki (JP)

(72) Inventors: Masahiro Toyohara, Hitachinaka (JP); Osamu Mukaihara, Hitachinaka (JP); Hideyuki Sakamoto, Hitachinaka (JP); Takao Fukuda, Hitachinaka (JP); Masayoshi Kawatsu, Hitachinaka (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 635 days.

(21) Appl. No.: 14/902,939

(22) PCT Filed: May 16, 2014

(86) PCT No.: PCT/JP2014/063012
§ 371 (c)(1),
(2) Date: Jan. 5, 2016

(87) PCT Pub. No.: WO2015/004988
PCT Pub. Date: Jan. 15, 2015

(65) Prior Publication Data

US 2016/0138511 A1 May 19, 2016

(30) Foreign Application Priority Data

Jul. 10, 2013 (JP) ..... 2013-144321

(51) Int. Cl.
*F02D 41/30* (2006.01)
*F02D 41/20* (2006.01)
(Continued)

(52) U.S. Cl.
CPC ..... *F02D 41/3005* (2013.01); *F02D 41/008* (2013.01); *F02D 41/20* (2013.01);
(Continued)

(58) Field of Classification Search
CPC ..... F02D 2041/2055; F02D 41/008; F02D 41/0085; F02D 41/20; F02D 41/2467;
(Continued)

(56) References Cited

U.S. PATENT DOCUMENTS 4,653,447 A * 3/1987 Linder ..... F02D 35/0007 123/357
4,788,960 A * 12/1988 Oshizawa ..... F02D 41/008 123/357
(Continued)

FOREIGN PATENT DOCUMENTS

DE 10 2005 052 023 A1 7/2006
EP 1 424 476 A1 6/2004
(Continued)

OTHER PUBLICATIONS

2008 C15 injector codes_ mpg—Discussion on Topix.*
(Continued)

*Primary Examiner* — Carl C Staubach
(74) *Attorney, Agent, or Firm* — Foley & Lardner LLP

(57) ABSTRACT

Provided is a control device for an internal combustion engine which can suppress a relative variation in the fuel injection amount for each cylinder. A drive pulse width to drive the fuel injection valve for injecting the fuel is calculated according to a driving state of the internal combustion engine, any one or both of a valve-opening response delay time and a valve-closing response delay time with respect to a drive pulse signal of the fuel injection valve for each fuel injection value are calculated, and the drive pulse width is corrected to make an injection amount of each fuel injection valve matched to a predetermined injection amount based on any one or both of the valve-opening response delay time and the valve-closing response delay time calculated for each fuel injection valve.

4 Claims, 14 Drawing Sheets

| | VALVE-OPENING RESPONSE DELAY TIME | VALVE-CLOSING RESPONSE DELAY TIME | ADDRESS OF CLOSING TIME | |
|---|---|---|---|---|
| # n_INJ | Td-OP-a | Td-CL-a | Td-Δ-a | |
| # n+1_INJ | Td-OP-b | Td-CL-b | Td-Δ-b | |
| # n+2_INJ | Td-OP-c | Td-CL-c | Td-Δ-c | Max (METHOD B) |
| # n+3_INJ | Td-OP-d | Td-CL-d | Td-Δ-d | Min (METHOD A) |
| AVERAGE | Td-OP-ave | Td-CL-ave | Td-Δ-ave | METHOD C |
| MASTER_INJ | Td-OP-mas | Td-CL-mas | Td-Δ-mas | METHOD D |

(51) Int. Cl.

| | |
|---|---|
| ***F02D 41/24*** | (2006.01) |
| ***F02D 41/00*** | (2006.01) |
| ***F02D 41/38*** | (2006.01) |
| ***F02M 63/00*** | (2006.01) |

(52) U.S. Cl.
CPC ..... *F02D 41/2467* (2013.01); *F02D 41/3809* (2013.01); *F02M 63/0015* (2013.01); *F02D 41/0085* (2013.01); *F02D 2041/2055* (2013.01)

(58) Field of Classification Search
CPC .. F02D 41/3005; F02D 41/3809; F02D 41/34; F02D 41/345; F02D 41/40; F02M 63/0015
See application file for complete search history.

(56) References Cited

U.S. PATENT DOCUMENTS 4,870,939 A * 10/1989 Ishikawa ..... F02D 41/408 123/357
5,375,575 A * 12/1994 Ohishi ..... F02D 41/0085 123/446
6,192,856 B1 * 2/2001 Shioi ..... F02D 41/20 123/300
6,962,140 B1 * 11/2005 Nakai ..... F02D 41/1498 123/436
9,273,627 B2 * 3/2016 Brandt ..... F02D 41/2096
9,926,874 B2 * 3/2018 Kusakabe ..... F02D 41/20
2001/0022320 A1 * 9/2001 Tojo ..... F02M 47/027 239/5
2006/0090733 A1 * 5/2006 Fujii ..... F02D 41/2438 123/446
2011/0100333 A1 * 5/2011 Toyohara ..... F02D 41/20 123/490
2012/0318883 A1 * 12/2012 Kusakabe ..... F02D 41/20 239/1
2013/0327300 A1 * 12/2013 Nonoyama ..... F02D 41/30 123/478

FOREIGN PATENT DOCUMENTS

| | | | |
|---|---|---|---|
| JP | 2000-179391 | A | 6/2000 |
| JP | 2001-280189 | A | 10/2001 |
| JP | 2003-113732 | A | 4/2003 |
| JP | 2006-125371 | A | 5/2006 |

OTHER PUBLICATIONS

PCT International Search Report on application PCT/JP2014/063012 dated Aug. 26, 2014; 4 pages.
Office Action dated Aug. 31, 2018 in German Application No. 11 2014 002 856.8 with its English translation.

* cited by examiner

| | VALVE-OPENING RESPONSE DELAY TIME | VALVE-CLOSING RESPONSE DELAY TIME | ΔOPENING/ CLOSING TIME | |
|---|---|---|---|---|
| #n_INJ | Td-OP-a | Td-CL-a | Td-Δ-a | |
| #n+1_INJ | Td-OP-b | Td-CL-b | Td-Δ-b | |
| #n+2_INJ | Td-OP-c | Td-CL-c | Td-Δ-c | Max (METHOD B) |
| #n+3_INJ | Td-OP-d | Td-CL-d | Td-Δ-d | Min (METHOD A) |
| AVERAGE | Td-OP-ave | Td-CL-ave | Td-Δ-ave | METHOD C |
| MASTER_INJ | Td-OP-mas | Td-CL-mas | Td-Δ-mas | METHOD D |

CONTROL DEVICE FOR INTERNAL COMBUSTION ENGINE

TECHNICAL FIELD

The present invent ion relates to a control device which controls a fuel injection valve of an internal combustion engine.

BACKGROUND ART

In an internal combustion engine, there is provided a control device which calculates an appropriate injection amount according to a driving state and controls a fuel injection valve to supply the fuel. A magnetic force generated by a current flowing to a coil built in the fuel injection valve for opening and maintaining an open state of the fuel injection valve is asserted to a valve body of the fuel injection valve, so that the valve body is opened or closed and the fuel is injected by the corresponding amount according to a valve-opening period.

Herein, the amount (the injection amount) of the injected fuel is mainly determined by a differential pressure between a pressure of the fuel and an atmosphere pressure of an injection port of the fuel injection valve and a time period during which the open state of the valve body is maintained and the fuel is injected. However, regarding the injection amount of the fuel injection valve, it is known that a variation is caused in an injection flow rate of each fuel injection valve by a variation in manufacturing processes of the fuel injection valve at an initial stage and a secular degradation of the fuel injection valve after being mounted in the internal combustion engine. Therefore, in a case where the variation in the injection amount of the fuel injection valve is large, an air fuel ratio control of the internal combustion engine is damaged in accuracy, and exhaust emission performance and drivability are affected. Therefore, it is necessary to more accurately control the fuel injection flow rate with respect to the variation of the fuel injection valve in order to inject an appropriate amount of fuel.

In order to solve the problem, it is generally known that the air fuel ration sensor is provided in an exhaust pipe of the internal combustion engine, and a feedback control to the fuel injection or an air fuel learning control is performed to make an exhaust air-fuel ratio be a desired air fuel ratio based on the output of the air fuel ration sensor.

In addition, as a method of handling a change in a valve-opening response and a valve-closing response of the fuel injection valve, PTL 1 discloses the description "there is disclosed a control device which compares a valve-opening delay and a valve-closing delay of the fuel injection valve with an initial valve-opening delay and an initial valve-closing delay to detect a change amount, and corrects a drive pulse based on the detected change amount. According to the control device, it is possible to suppress the degradation with time of the fuel injection valve and a change in the injection amount caused by an abnormality while supplying an appropriate fuel amount at any time".

CITATION LIST

Patent Literature

PTL 1: JP 2001-280189 A (see paragraph 0055 in the specification)

SUMMARY OF INVENTION

Technical Problem

In the technology disclosed in PTL 1, the secular degradation in the valve-opening response and the valve-closing response of each fuel injection valve provided in the internal combustion engine is improved so that the fuel injection period is stabilized. However, there occurs a variation in the respective injection amounts of all the fuel injection valves provided in the internal combust ion engine (that is, a relative variation of the injection amount of the fuel supplied to each cylinder).

The invention has been made in view of the above problem, and an object thereof is to provide a control device of an internal combustion engine which can suppress the relative variation in the injection amount of the fuel supplied to each cylinder.

Solution to Problem

In order to achieve the above object, a control device of an internal combustion engine according to the invention calculates a drive pulse width to drive the fuel injection valve for injecting the fuel according to a driving state of the internal combustion engine, and corrects the drive pulse width to make the injection amount of each fuel injection valve matched to a predetermined injection amount based on any one or both of a valve-opening response delay time and a valve-closing response delay time with respect to a drive pulse signal of the fuel injection valve for each fuel injection valve, or an air-fuel ratio difference between the cylinders.

Advantageous Effects, of Invention

According to the invention, it is possible to suppress a relative variation in an injection, amount of fuel supplied to each cylinder and, as a result, accuracy of an air fuel, ratio control of in internal combustion engine can be improved.

DESCRIPTION OF EMBODIMENTS

Hereinafter, some examples of a fuel injection control device (control device) of a cylinder fuel injection type of internal combustion engine according to embodiments of the invention will be described using FIGS. 1 to 22.

First Embodiment

Figure 1:
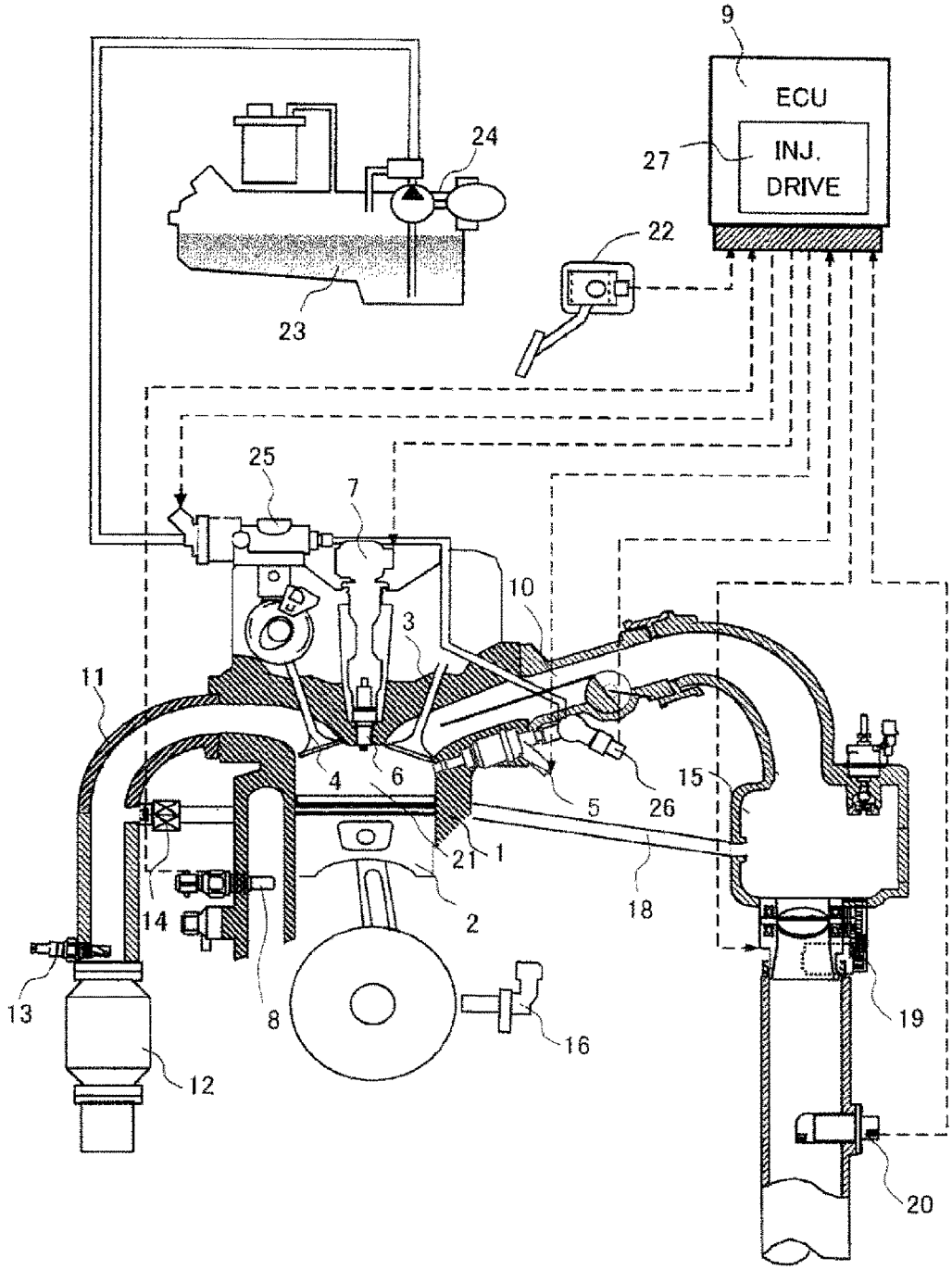
FIG. 1 is a diagram illustrating the entire configuration of an internal combustion engine system equipped with a fuel injection control device according to a first embodiment.

First, the description will be made about a configuration of an internal combustion engine system equipped with the fuel injection control device according to this embodiment. FIG. 1 is a diagram illustrating the entire configuration of the internal combustion engine system equipped with the fuel injection control device according to the embodiment.

As illustrated in FIG. 1, an engine (the internal combustion engine) is provided with a piston 2, an intake valve 3, and an exhaust valve 4. The air (intake air) flowing into the engine 1 passes through an air flow meter (AFM) 20 and is adjusted in its flow rate by a throttle valve 19, and is supplied to a combustion chamber 21 of the engine 1 from a collector 15 serving as a branch portion through an intake pipe 10 and the intake valve 3.

The fuel is supplied from a fuel tank 23 to a high pressure fuel pump 25 by a low pressure fuel pump 24, and is increased in pressure necessary for the fuel injection by the high pressure fuel pump 25. Then, the fuel increased in pressure by the high pressure fuel pump 25 is directly injected into the combustion chamber 21 of the engine 1 from a fuel injection valve 5, and is ignited using an ignition coil 7 and an ignition plug 6. The pressure of the fuel supplied to the fuel injection valve 5 is measured by a fuel pressure sensor (pressure sensor) 26. In addition, the fuel injection valve 5 is an electromagnetic fuel injection valve which is operated when a drive current is supplied (energized) to an electromagnetic coil (described below). The fuel injection valve supplies the fuel to each of a plurality of cylinders, but in this embodiment it is assumed that the fuel injection valve is provided in each cylinder.

The exhaust gas after the combustion is discharged to an exhaust pipe 11 through the exhaust valve 4. The exhaust pipe 11 is provided with a three-way catalyst 12 in order to make the exhaust gas clean. The exhaust pipe 11 and the collector 15 are connected through an EGR passage 18. An EGR valve 14 is provided in the middle of the EGR passage 18. An opening of the EGR valve 14 is controlled by an ECU 9, and the exhaust gas in the exhaust pipe 11 flows back to the intake pipe 10 as needed.

The engine control unit (ECU) 9 is an electronic controller equipped with a microcomputer, and includes a fuel injection control device (control device) 27. The ECU 9 receives a crank angle signal of a crank angle sensor 16 of the engine 1, an intake air amount signal of the AFM 20, an oxygen concentration signal of an oxygen sensor 13 which detects an oxygen concentration in the exhaust gas, an accelerator opening signal of an accelerator opening sensor 22, and a fuel pressure signal of the fuel pressure sensor 26. In addition, the ECU 9 calculates a target torque of the engine based on the signal of the accelerator opening sensor 22, and determines whether it is an idle state.

The ECU 9 includes a speed detection unit which calculates an engine speed based on the crank angle signal of the crank angle sensor 16. Furthermore, the ECU 9 is provided with a unit which determines whether the three-way catalyst 12 is heated up based on a water temperature of the engine obtained by a water temperature sensor 8 and an elapsed time after the engine is started.

In addition, the ECU 9 calculates an intake air amount necessary for the engine 1, and outputs a throttle opening signal corresponding to the calculated intake air amount to the throttle valve 19. The fuel injection control device 27 calculates an injection amount (a target injection amount) corresponding to the intake air amount, outputs a fuel injection signal (a signal corresponding to a drive pulse width) to the fuel injection valve 5 based on the calculated fuel injection amount, and outputs an ignition signal to the ignition plug 6. In this embodiment, the engine (the internal combustion engine) 1 of the direct injection (cylinder injection) type has been exemplified, but the invention is not limited thereto. For example, an engine of a port injection type may be employed as long as the fuel injection valve is provided to supply the fuel to each cylinder.

Figure 2:
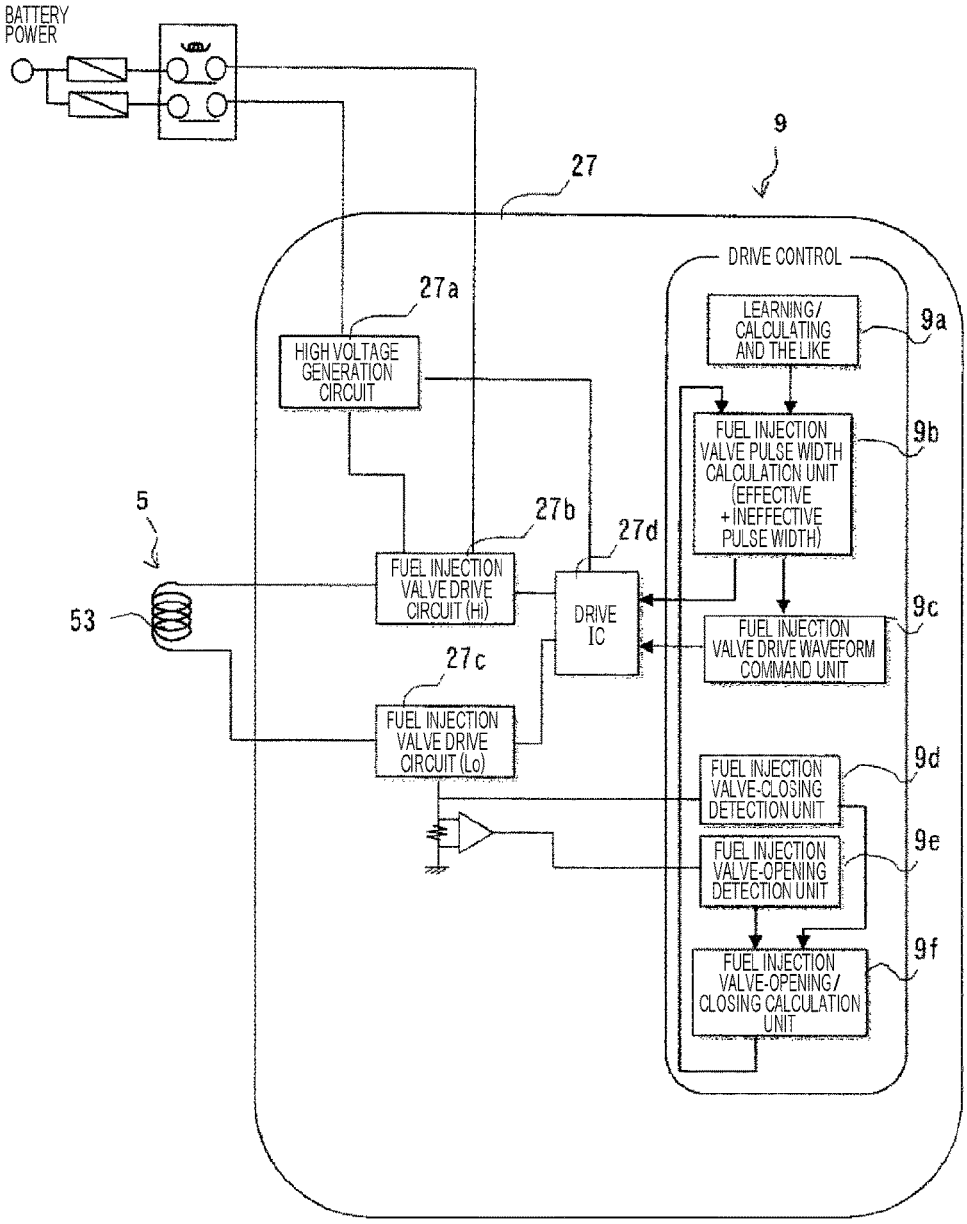
FIG. 2 is a diagram illustrating the configuration of the fuel injection control device according to the first embodiment.

FIG. 2 is a diagram illustrating a configuration of the fuel injection control device 27 according to this embodiment, and the fuel injection control device is equipped with the ECU 9 as illustrated in FIG. 1.

The fuel injection control device 27 calculates an appropriate energizing time and an injection start timing according to a driving state of the engine 1. The fuel injection control device switches between a fuel injection valve drive circuit (Hi) 27*b* and a fuel injection valve drive circuit (Lo) 27*c* using a drive IC 27*d*, and supplies the drive current (excitation current) to an electromagnetic coil (an electromagnetic solenoid for driving the valve to be opened) 53 of the fuel injection valve 5.

A high voltage generation circuit 27*a* generates a high power voltage necessary for opening the fuel injection valve based on the battery power of the engine. The high power voltage generates a desired power voltage in response to a command to generate the high power voltage from the drive IC 27*d*.

The fuel injection valve drive circuit 27*b* includes a switching element, and is connected between the high voltage generation circuit 27*a* and the electromagnetic coil 53 and between the battery power and the electromagnetic coil 53. The fuel injection valve drive circuit 27*b* selects any one of the high power voltage generated by the high voltage generation circuit 27*a* and a low power voltage of the battery power with respect to the fuel injection valve 5, and supplies the selected power voltage to the electromagnetic coil 53 of the fuel injection valve 5. When the fuel injection valve 5 is opened from a close state, the high power voltage is selected and supplied so as to supply the valve-opening current (the drive current) necessary for opening the valve to the electromagnetic coil 53 of the fuel injection valve 5. In a case where an open state of the fuel injection valve 5 is maintained, the power voltage is switched to the battery voltage (the low power voltage), and a holding current (the drive current) flows to the electromagnetic coil of the fuel injection valve 5.

Similarly to the fuel injection valve drive circuit (Hi) 27*b*, the fuel injection valve drive circuit (Lo) 27*c* serves as a drive circuit provided on the downstream side of the fuel injection valve to make the drive current flow (supplied) to the fuel injection valve 5.

The drive IC 27*d* outputs drive signals to these circuits 27*a* to 27*c*, and controls the driving of these circuits 27*a* to 27*c* to supply a desired drive current to the electromagnetic coil 53 of the fuel injection valve 5, and controls the fuel injection of the fuel injection valve 5. Therefore, through the drive control of the fuel injection valve, the fuel injection amount necessary for the combustion of the engine is optimally controlled.

A drive period (time taken for energizing the fuel injection valve), a drive power voltage value, and a drive current value of the fuel injection valve 5 by the drive IC 27*d* are controlled by a command calculated by a fuel injection valve pulse width calculation unit 9*b* and a fuel injection valve drive waveform command unit 9*c*. Specifically, the fuel injection valve pulse width calculation unit 9*b* calculates a drive pulse width TI for driving the fuel injection valve 5 to inject the fuel (a drive pulse calculation unit) according to the driving state of the engine (specifically, based on the above-described target injection amount). Furthermore, the fuel injection valve pulse width calculation, unit 9*b* corrects the calculated drive pulse width TI by a correction method described below (a pulse width correction unit), and outputs the corrected drive pulse width to the drive IC 27*d*.

On the other hand, the fuel injection valve drive waveform command unit 9*c* selects, for example, a waveform (a current profile) of the drive current to be supplied to the electromagnetic coil 53 of the fuel injection valve 5 based on a calculation result of the fuel injection valve pulse width calculation unit 9*b* and the driving state of the internal combustion engine, and outputs the drive current to the drive IC 27*d*. Further, the fuel injection valve pulse width calculation unit 9*b* is configured to calculate a more optimal pulse width by reading learned data obtained through a learning/calculating unit 9*a*.

Furthermore, in this embodiment, there are provided a fuel injection valve-closing detection unit (a valve-closing response delay time calculation unit) 9*d* which detects a valve-closing response delay time corresponding to a drive pulse signal of each fuel injection valve 5, and a fuel injection valve-opening detection unit (a valve-opening response delay time calculation unit) 9*e* which detects a valve-opening response delay time corresponding to the drive pulse signal for each fuel inject ion valve 5.

Specifically, the fuel injection valve-closing detection unit 9*d* detects a change of the voltage on the Low side of the fuel injection valve 5, and calculates the valve-closing response delay time caused by the change of the subject voltage in synchronization with the closing of the fuel injection valve 5 from an OFF timing of the pulse of the fuel injection valve 5 (a close-command timing of the drive pulse signal) until the fuel injection valve 5 enters the close state.

On the other hand, the fuel injection valve-opening detection unit 9*e* detects a change of the current supplied from the Low side of the fuel injection valve 5 to the fuel injection valve 5, and calculates the valve-opening response delay time caused by the change of the subject current in synchronization with the opening of the fuel injection valve 5 from an ON timing of the pulse to drive the fuel injection (a timing for an open command of the drive pulse signal) until the fuel injection valve 5 enters the open state. In this way, the fuel injection valve-closing detection unit 9*d* and the fuel injection valve-opening detection unit 9*e* calculate the valve-closing response delay time and the valve-opening response delay time for each fuel injection valve with respect to all the fuel injection valves provided in the engine 1.

An fuel inject ion valve-opening/closing calculation unit 9*f* obtains a difference between the valve-opening response delay time and the valve-closing response delay time for each fuel injection valve 5 based on the valve-opening response delay time and the valve-closing response delay time of each fuel injection valve 5 detected by the fuel injection valve-closing detection unit 9*d* and the fuel injection valve-opening detection unit 9*e*. The fuel injection valve pulse width calculation unit 9*b* to corrects the drive pulse width of each fuel injection valve 5 based on the valve-opening response delay time and the valve-closing response delay time of each fuel injection valve calculated by the subject block 9*f*. Herein, a method of correcting an injection pulse width according to the invention will be described below. From the above description, the fuel injection valve is controlled in its driving and in its fuel injection amount necessary for the combustion of the engine according to an individual difference of the fuel injection valve.

Figure 3:
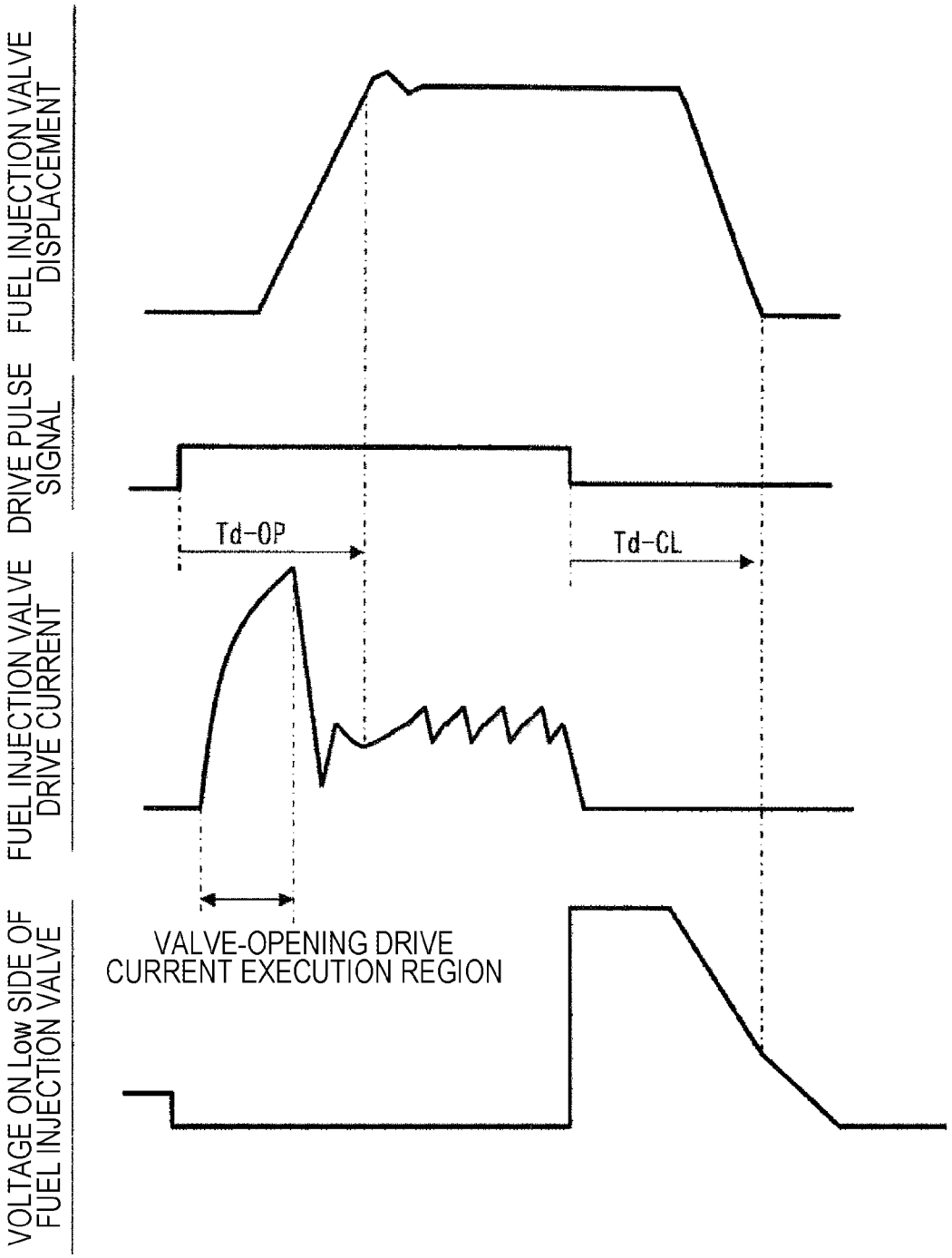
FIG. 3 is a diagram for describing an example of a method of detecting a valve-opening response delay time and a valve-closing response delay time of a fuel injection valve according to the first embodiment.

FIG. 3 is a diagram for describing an example of a method of detecting the valve-opening response delay time and the valve-closing response delay time of the fuel injection valve according to the invention.

The drive current illustrated on the lower stage is supplied to the fuel injection valve based on the drive pulse signal of the fuel injection valve illustrated in the drawing. Further, the drive pulse signal is a signal output based on the drive pulse width calculated according to the driving state of the internal combustion engine and a timing of the open command. Herein, in the case of the fuel injection valve of the direct injection type, a relatively high valve-opening current is supplied to make the fuel injection valve rapidly opened at the initial stage of the drive pulse supply, and then a holding current smaller than the valve-opening current is supplied to maintain the open state of the fuel injection valve 5. The profile of the drive current of the fuel injection valve 5 is generally well known, and the detailed description thereof will not be given herein.

The Low-side voltage of the fuel injection valve in the drawing is a voltage on the GND side (downstream side) of the fuel injection valve. At the same time when the drive pulse signal is turned off to drive the fuel injection valve 5, a counter electromotive voltage is generated by a coil provided in the fuel, injection valve and a Zener diode provided in the drive circuit. This drive configuration and a voltage behavior are generally well known, and the detailed description thereof will not be given herein.

A fuel injection valve displacement on the upper, stage of the drawing shows a behavior of the fuel injection valve according to the drive pulse signal of the fuel injection valve and the corresponding drive current. The fuel injection valve starts to be opened after the drive current is supplied (the drive pulse signal is turned on) and then a predetermined time elapses based on a relation of a force of a spring provided in the fuel injection valve, a pressure of the fuel supplied to the fuel injection valve, and a drive current (a magnetic force) of the fuel injection valve, and shifts up to a completely-opened position.

On the other hand, the fuel injection valve starts to be closed after the supply of the drive current is blocked (the drive pulse signal is turned off) and then a predetermined time elapses based on a relation opposite to the opening behavior of the fuel injection valve, and shifts up to a completely-closed position.

A response time from after the drive pulse signal is turned on until the fuel injection valve is opened (that is, a valve-opening response delay time from a timing of the open command of the drive pulse signal to the fuel injection valve until the fuel injection valve enters the open state) is denoted by Td-OP in the drawing. A valve-closing response delay time from a close-command timing of the drive pulse signal to the fuel injection valve until the fuel injection valve enters the close state is denoted by Td-CL in the drawing. Hereinafter, the valve-opening response delay time will be referred to as Td-OP, and the valve-closing response delay time will be referred to as Td-CL.

There is an individual difference in the valve-opening response delay time Td-OP and the valve-closing response delay time Td-CL by a variation in manufacturing processes of the fuel injection valve. The individual difference of the fuel injection valve is mainly caused by a spring set load in the fuel injection valve and various other factors. In the invention, since there is no direct relation with the various factors of the variation, the detailed description thereof will be omitted.

As described above, the valve-opening response delay time Td-OP can be detected by determining a change of the drive current of the fuel injection valve, and the valve-closing response delay time Td-CL can be detected, by determining a change of the voltage on the Low side of the fuel injection valve. An example of these configurations is disclosed in PTL 1 described above.

From the above description, the valve-opening response delay time Td-OP and the valve-closing response delay time Td-CL of each fuel injection valve 5 provided in the engine can be determined by detecting the drive current and the voltage on the Low side of the fuel injection valve.

Figure 4:
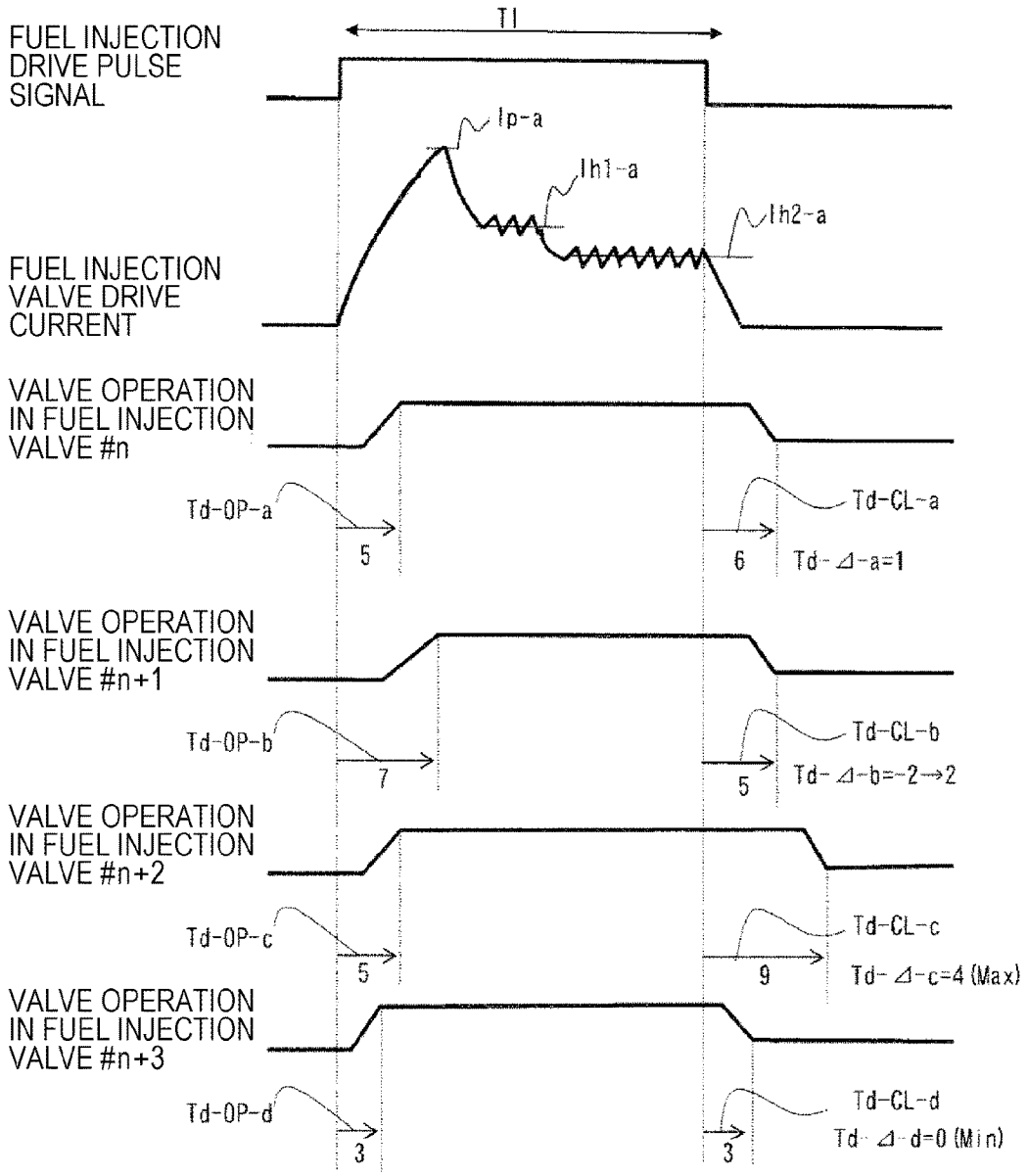
FIG. 4 is a diagram for describing an example of a variation in the injection amount of the fuel injection valve.

FIG. 4 is a diagram for describing an example of a variation in the injection amount of the fuel injection valve. A pulse signal for driving the fuel injection and a drive current of a fuel injection valve in the drawing are waveforms described in FIG. 3. An open-close operation of the respective fuel injection valves provided in the engine (an example of four cylinders in the drawing) by the drive pulse signal is illustrated. The fuel injection valve of the cylinder #n is opened after the valve-opening response delay time Td–OP–a from the start of the drive pulse signal, and closed after the valve-closing response delay time Td–CL–a from the end of the drive pulse signal. Similarly, as illustrated in the drawing, the valve-opening response delay times and the valve-closing response delay times of the fuel injection valves #n+1 to #n+3 provided in the other cylinders become the values Td–OP–b to Td–OP–d and TD–CL–b to D–CL–d of the fuel injection valves, respectively.

In this way, even is the ease of the fuel injection valves provided in one engine, the valve-opening response delay times and the valve-closing response delay times of the respective fuel injection, valves become different due to a variation in manufacturing processes or a secular degradation of the fuel injection valves.

Figures 5, 6:
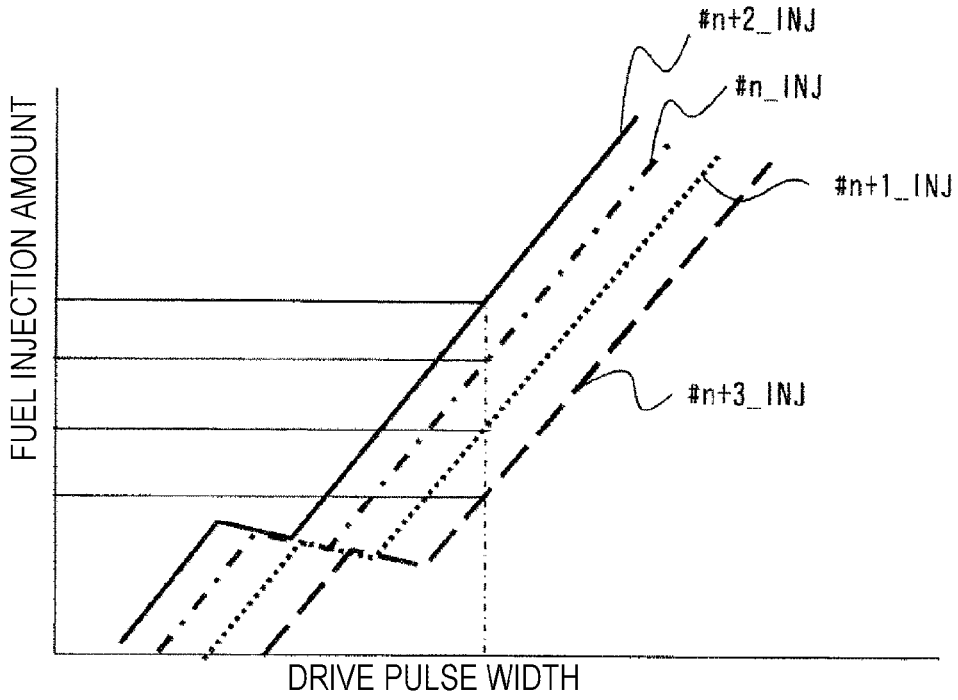
FIG. 5 is a diagram illustrating an example of injection amount characteristics of the fuel injection valves depending on a difference in the valve-opening response delay times and the valve closing response delay times of the fuel injection valves illustrated in FIG. 4.
FIG. 6 is a diagram for describing a method of correcting a drive pulse width according to the first embodiment.

FIG. 5 is a diagram illustrating an example of injection amount characteristics of the fuel injection valves depending on a difference in the valve-opening response delay times and the valve-closing response delay times of the fuel injection valves illustrated in FIG. 4.

As the valve-opening response delay time (Td-OP) of the fuel injection valve becomes shorter, or as the valve-closing response delay time (Td-CL) becomes longer, the injection flow rate of the fuel injected to the same drive pulse width becomes larger. On the contrary, as the valve-opening response delay time (Td-OP) of the fuel injection valve becomes longer, or as the valve-closing response delay time (Td-CL) becomes shorter, the injection flow rate of the fuel injected to the same injection pulse width becomes lesser.

The above configuration depends on an open period (a time when the open state is maintained) of the fuel injection valve with respect to the same drive pulse width (a time when the open state is maintained). As illustrated in the drawing, the flow rate characteristics of the respective fuel injection valves are illustrated in parallel to each other with respect to the drive pulse width of the fuel injection. In other words, an individual difference of the fuel injection valve is caused by the valve-opening response delay time and the valve-closing response delay time. Therefore, in a case where the pulse signals having the same drive pulse width are output to the respective fuel injection valves, the differences of the fuel injection amounts for the respective fuel injection valves are almost the same regardless of the drive pulse width.

As a method of making the fuel injection flow rate (the fuel injection amount) of the fuel with accuracy even when the valve-opening response delay times and the valve-closing response delay times of the respective fuel injection valves are different, the variation in the fuel injection amount caused from the valve response delays of the respective fuel injection valves can be reduced by correcting the drive pulse widths such that the respective fuel injection valves correspond to the same fuel injection amount based on a parallel shift component (specifically, one or both of the value response delay time and the valve-closing response delay time).

FIG. 6 is a diagram for describing a method, of correcting the drive pulse width according to this embodiment, and some correction examples according to this embodiment will be described below. Further, FIG. 6 shows a list of the valve-opening response delay times and the valve-closing response delay times of the fuel injection valves provided in the engine illustrated in FIGS. 4 and 5. In the rows of the table of FIG. 6, the valve-opening response delay time, the valve-closing response delay time, and a difference therebetween are denoted. In the column of the table of FIG. 6, characteristics and average values of the respective fuel injection valves provided in the engine, and master fuel injection valves as basic characteristics are denoted. Further, these times show the numerical values exemplified in FIG. 4.

First Example: Method A

Figure 7:
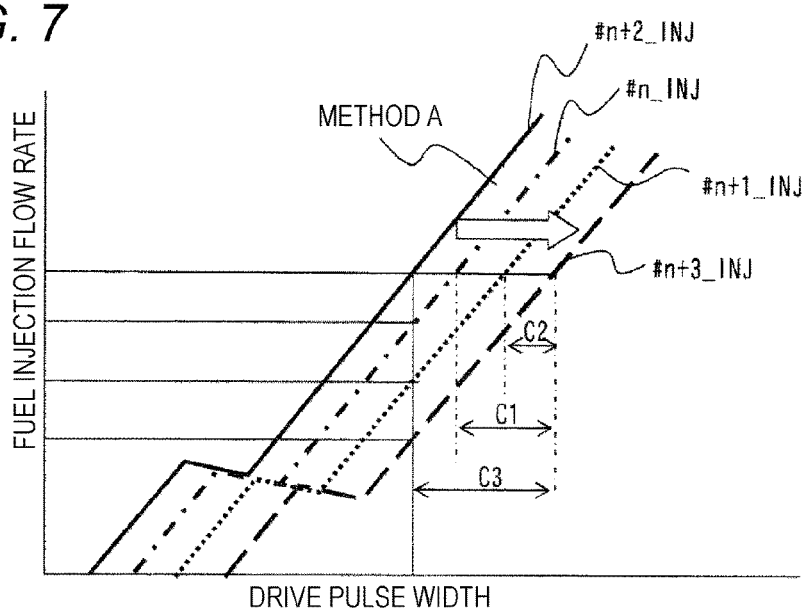
FIG. 7 is a diagram for describing a correction method according to a first example.
Figure 8:
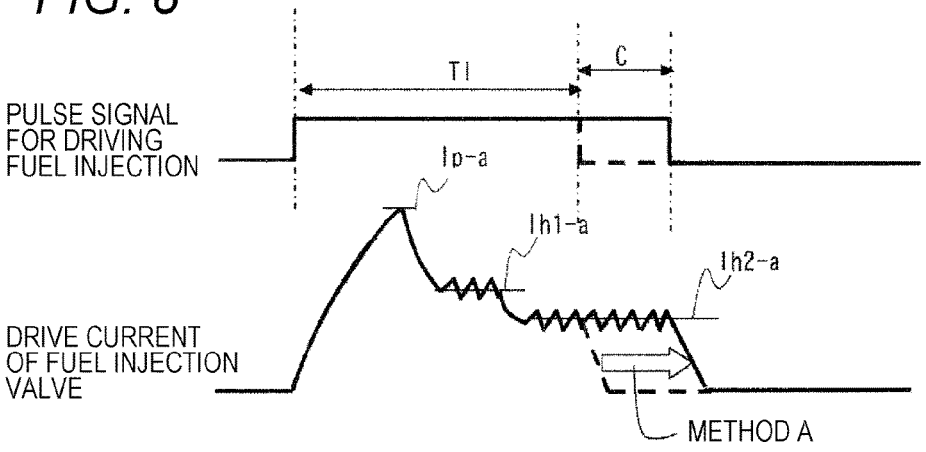
FIG. 8 is a diagram illustrating the corrected drive pulse width in FIG. 7 and a drive current.

FIG. 7 is a diagram for describing a correction method according to a first example, and FIG. 8 is a diagram illustrating the corrected drive pulse width in FIG. 7 and the drive current. In the first example, the fuel injection valve having a minimum value (Min in FIG. 6) of the difference between the valve-opening response delay time and the valve-closing response delay time of the fuel injection valve provided in the engine is selected, and the drive pulse width is corrected in accordance to the characteristic of the fuel injection, valve having the minimum value.

Specifically, first, as described above, the valve-opening response delay time and the valve-closing response delay time of the fuel injection valve 5 are calculated with respect to the fuel injection valves #n to #n+3 by the fuel injection valve-closing detection unit (the valve-closing response delay time calculation unit) 9*d*, the fuel injection valve-opening detection unit (the valve-opening response delay time calculation unit) 9*e*. A valve-opening time is a time from a valve-opening timing of the drive pulse signal to the fuel injection valve 5 until the fuel injection valve 5 enters the open state. A valve-closing time is a time from a valve-closing timing of the drive pulse signal to the fuel injection valve 5 until the fuel injection valve 5 enters the close state.

Next, the fuel injection valve-opening/closing calculation unit 9*f* calculates differences (valve-opening response delay time—valve-closing response delay time) Td−Δ−a to Td−Δ−d for the respective fuel injection valves based on the valve-opening response delay times and the valve-closing response delay times of the respective fuel injection valves 5. Based on the result, the fuel injection valve pulse width calculation unit 9*b* selects the fuel injection valve having the smallest different (specifically, an absolute value) between the valve-closing response delay time and the valve-opening response delay time as a reference fuel injection valve among the fuel injection valves #n to #n+3. In this case of this example, the fuel injection valve #n+3 is selected. Furthermore, the fuel injection valve pulse width calculation unit 9*b* corrects the drive pulse widths of the other fuel injection valves (#n, #n+1, and #n+2) in accordance with the injection amount injected by the selected fuel injection valve (the fuel injection valve #n+3). In other words, in this example, a difference between each of the differences Td−Δ−a to Td−Δ−c of the left fuel injection valves and the difference Td−Δ−d of the selected fuel injection valve #n+3 becomes a correction amount of each drive pulse width.

Specifically, for example, in the case of the fuel injection valve #n, a correction amount C1 with respect to the drive pulse width TI calculated according to the driving state is a difference between Td−Δ−a and Td−Δ−a, and the drive pulse width TI is corrected based on the correction amount, and the injection amount of the fuel injection valve #n approaches the injection amount of the fuel injection valve #n+3. Similarly, in the case of the fuel injection valves #n+1 and #n+2, correction amounts C2 and C3 with respect to the drive pulse width TI calculated according to the driving state are a difference between Td−Δ−d and Td−Δ−b and a difference between Td−Δ−d and Td−Δ−c, the drive pulse width TI is corrected based on the correction amounts, and the injection amounts of the fuel injection valves #n+1 and #n+2 approach the injection amount of the fuel injection valve #n+3.

In this way, it is possible to increase the accuracy in control of the fuel injection amount of the fuel injection valve by detecting the variation of the parallel shift component of the fuel injection valve to correct the pulse width. In addition, the fuel injection amount is stabilized by correcting the pulse width in correspondence to the variation between the cylinders of the engine, and an air fuel ratio control can be realized with high accuracy.

Furthermore, in the case of this example, the fuel injection valve #n+3 having the smallest difference (specifically, an absolute value) between the valve-closing response delay time and the valve-opening response delay time is most difficult to be opened compared to the other fuel injection valves #n to #n+2. On the contrary, the injection amounts of the fuel injection valves #n to #n+2 easily opened can be easily matched to the injection amount of the fuel injection valve #n+3. In other words, as illustrated in FIG. 8, valve-opening periods of the fuel injection valves #n to #n+2 are easily lengthened by adding the correction amount C (C1 to C3) to the drive pulse widths T1 of the fuel injection valves #n to #n+2 (that is, the correction is made to make the drive pulse widths T1 long). As such a result, in this example, there is no possibility that the fuel injection valve enters a valve-opening drive current execution region. Therefore, even in a case where the drive pulse width correction is performed, it is possible to stably and reliably supply the sufficient valve-opening current necessary for the fuel injection.

Second Example: Method B

Figure 9:
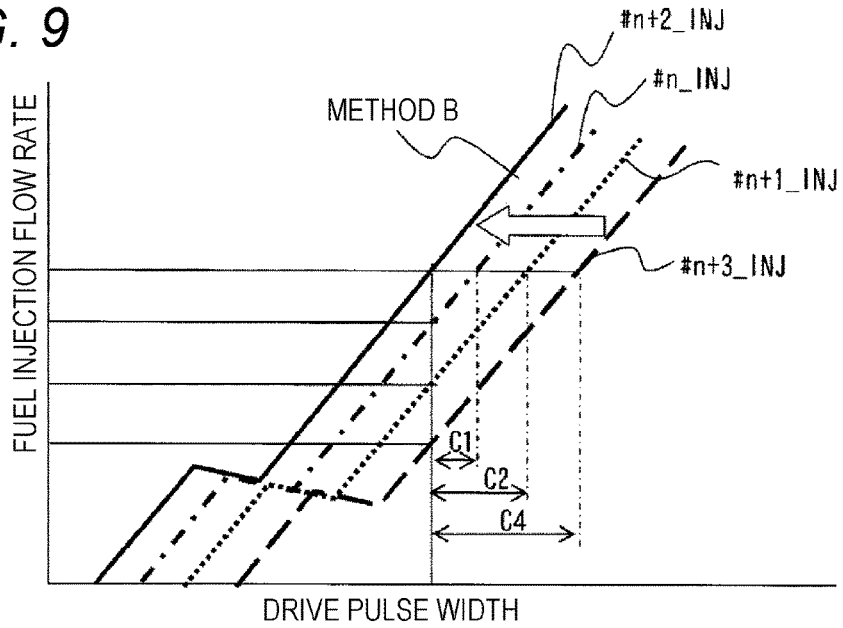
FIG. 9 is a diagram for describing a correction method according to a second example.
Figure 10:
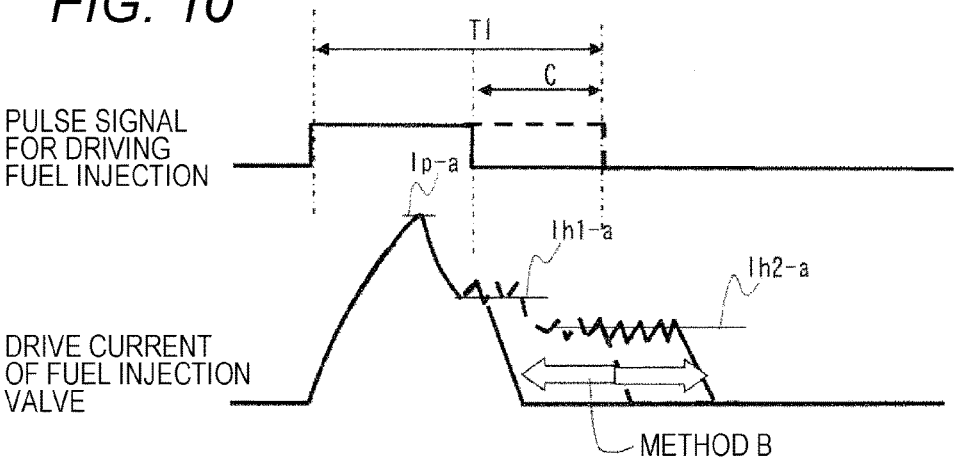
FIG. 10 is a diagram illustrating the corrected drive pulse width in FIG. 3 and the drive current.

FIG. 9 is a diagram for describing a correction method according to a second example, and FIG. 10 is a diagram illustrating the corrected drive pulse width in FIG. 9 and the drive current. In the second example, the fuel injection valve having a maximum value (max in FIG. 6) of the difference between the valve-opening response delay time and the valve-closing response delay time of the fuel injection valve provided in the engine is selected, and the drive pulse width is corrected in accordance to the characteristic of the fuel injection valve having the maximum value.

Specifically, similarly to the first example, the valve-opening response delay time and the valve-closing response delay time of the fuel injection valve 5 are calculated with respect to the fuel injection, valves #n to #n+3 by the fuel injection valve-closing detection unit (the valve-closing response delay time calculation unit) 9*d*, the fuel injection valve-opening detection unit (the valve-opening response delay time calculation unit) 9*e*. Next, the fuel injection valve-opening/closing calculation unit 9*f* calculates differences (valve-opening response delay time—valve-closing response delay time) Td−Δ−a to Td−Δ−d for the respective fuel injection valves based on the valve-opening response delay times and the valve-closing response delay times of the respective fuel injection valves 5. Based on the result, the fuel injection valve pulse width calculation unit 9*b* selects the fuel injection valve having the largest different (specifically, an absolute value) between the valve-closing response delay time and the valve-opening response delay time as a reference fuel injection valve among the fuel injection valves #n to #n+3. In this case of this example, the fuel injection valve #n+2 is selected. Furthermore, the fuel injection valve pulse width calculation unit 9*b* corrects the drive pulse widths of the other fuel injection valves (#n, #n+1, and #n+3) in accordance with the injection amount injected by the selected fuel injection valve (the fuel injection valve #n+2). In other words, in this example, a difference between each of the differences Td−Δ−a, Td−Δ−b, and Td−Δ−d of the left fuel injection valves and the difference Td−Δ−c of the selected fuel injection valve #n+2 becomes a correction amount of each drive pulse width.

Specifically, for example, in the case of the fuel injection valve #n, a correction amount C1 with respect to the drive pulse width T1 calculated according to the driving state is a difference between Td−Δ−c and Td−Δ−a, and the drive pulse width TI is corrected based on the correction amount, and the injection amount of the fuel injection valve #n approaches the injection amount of the fuel injection valve #n+2. Similarly, in the case of the fuel injection valves #n+1 and #n+3, correction amounts C2 and C4 with respect to the drive pulse width TI calculated according to the driving state are a difference between Td−Δ−c and Td−Δ−b and a difference between Td−Δ−c and Td−Δ−d, the drive pulse width TI is corrected based on the correction amounts, and the injection amounts of the fuel injection valves #n+1 and #n+3 approach the injection amount of the fuel injection valve #n+2.

In this way, similarly to the first example, it is possible to increase the accuracy in control of the fuel injection amount of the fuel injection valve by detecting the variation of the parallel shift component of the fuel injection valve to correct the pulse width. In addition, the fuel injection amount is stabilized by correcting the pulse width in correspondence to the variation between the cylinders of the engine, and an air fuel ratio control can be realized with high accuracy.

Furthermore, as illustrated in FIG. 10, valve-opening periods of the fuel injection valves #n to #n+2 are shortened by adding the correction amount C (C1, C2, and C4) to the drive pulse widths T1 of the fuel injection valves #n, #n+1, and #n+3 (that is, the correction is made to make the drive pulse width T1 short). Therefore, for example, in a case where the respective fuel injection valves divisionally inject the fuel, it is possible to more accurately inject the fuel. However, in this example, when the fuel injection valve correcting the drive pulse width becomes a pulse width of the valve-opening drive current execution region, a sufficient valve-opening current cannot be supplied for injecting the fuel. Therefore, it is desirable to restrict the correction amount such that the open state of the fuel injection valve can be maintained.

Third Example: Method C

Figure 11:
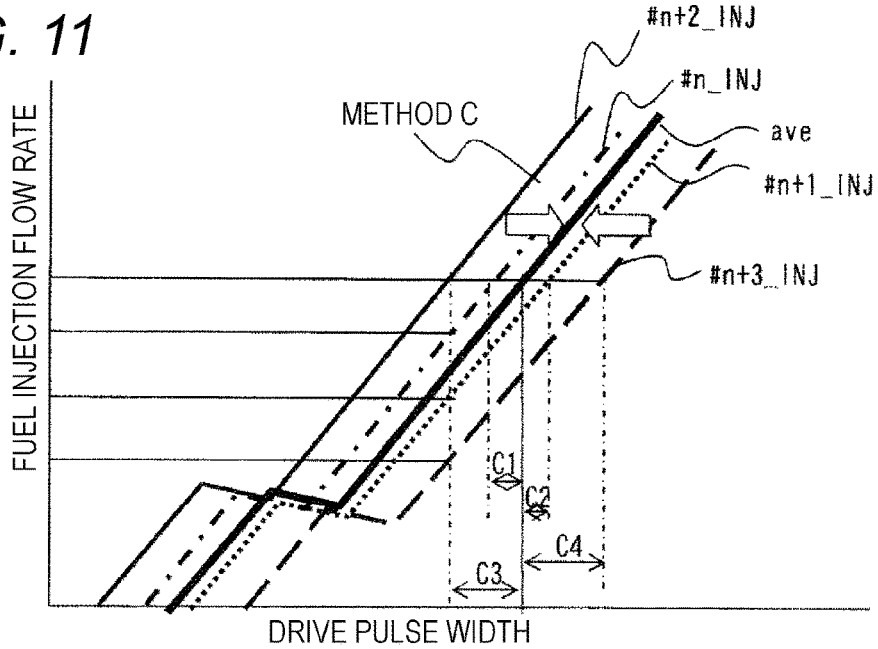
FIG. 11 is a diagram for describing correction method according to a third example.
Figure 12:
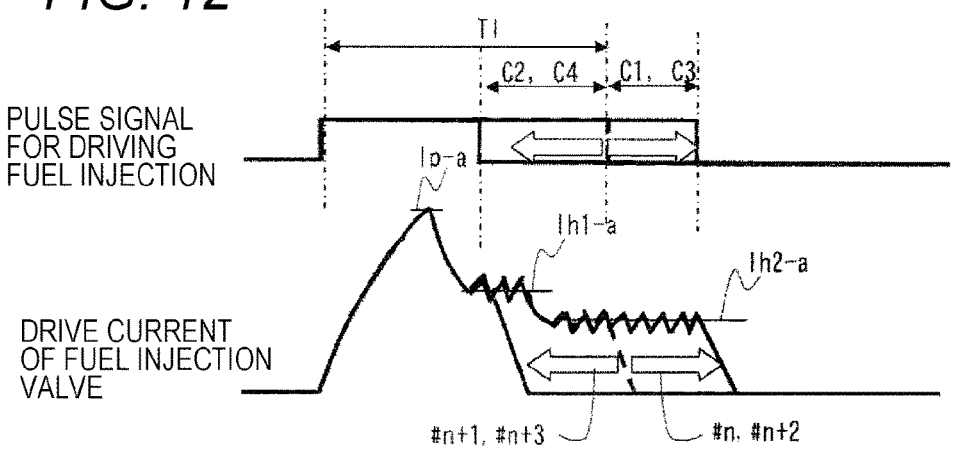
FIG. 12 is a diagram illustrating the corrected drive pulse width in FIG. 11 and the drive current.

FIG. 11 is a diagram for describing a correction method according to a third example, and FIG. 12 is a diagram illustrating the corrected drive pulse width in FIG. 11 and the drive current. In the third example, an average value (Td−Δ−ave in FIG. 6) of the differences (magnitudes) of the valve-closing response delay times calculated for the respective fuel injection valves and the valve-closing response delay times is calculated, and the pulse widths of the respective fuel injection valves are corrected to be matched to an injection amount corresponding to the average value (the average value ave of the non-injection amounts of the respective fuel injection valves) based on the average value and the valve-closing response delay times calculated for the respective fuel injection valves and the valve-closing response delay times.

Specifically, similarly to the first example, the valve-opening response delay time and the valve-closing response delay time of the fuel injection valve 5 are calculated with respect to the fuel injection valves #n to #n+3 by the fuel injection valve-closing detection unit (the valve-closing response delay time calculation unit) 9*d*, the fuel injection valve-opening detection unit (the valve-opening response delay time calculation unit) 9*e*. Next, the fuel injection valve-opening/closing calculation unit 9*f* calculates a valve-opening response delay average time Td−OP−ave and a valve-closing response delay average time Td−CL−ave which are the average values of the valve-opening response delay times and the valve-closing response delay times of all the fuel injection valves, respectively.

The differences (valve-opening response delay time-valve-closing response delay time) Td−Δ−a to Td−Δ−d and the difference Td−Δ−ave between the valve-opening response delay average time Td−OP−ave and the valve-closing response delay average time Td−CL−ave are calculated for the respective fuel injection valves. The drive pulse widths of all the fuel injection valves (#n to #n+3) are corrected based on the differences (Td−Δ−a to Td−Δ−d) between the valve-opening response delay times and the valve-closing response delay times of the respective fuel injection valves 5 and the average value Td−Δ−ave (that is, to be matched to the average value of the fuel injection valves #n to #n+3). In other words, in this example, differences (degradations) from the average value Td−Δ−ave with respect to these differences (Td−Δ−a to Td−Δ−d) become the correction amounts of the respective drive pulse widths.

Specifically, for example, in the case of the fuel injection valves #n and #n+2, the correction amounts C1 and C3 with respect to the drive pulse width TI calculated according to the driving state become differences between Td−Δ−ave, and Td−Δ−a and Td−Δ−c. The drive pulse width TI is corrected based on the correction amounts, and the injection amount approaches the injection amount ave of the fuel injection valve corresponding to the average value. In the case of the fuel injection valves #n and #n+2, the drive pulse width T1 is corrected to be lengthened. On the other hand, in the case of the fuel injection valves #n+1 and #n+3, the correction amounts C2 and C4 with respect to the drive pulse width TI calculated according to the driving state are the differences between Td−Δ−ave, and Td−Δ−b and Td−Δ−d. The drive pulse width TI is corrected based on the correction amounts, and the injection amount approaches the injection amount ave of the fuel injection valve corresponding to the average value. In the case of the fuel injection valves #n+1 and #n+3, the drive pulse width T1 is corrected to be shortened.

In this way, similarly to the first example, it is possible to increase the accuracy in control of the fuel injection amount of the fuel injection valve by detecting the variation of the parallel shift component of the fuel injection valve to correct the pulse width. In addition, the fuel injection amount is stabilized by correcting the pulse width in correspondence to the variation between the cylinders of the engine, and an air fuel ratio control can be realized with high accuracy.

Furthermore, as illustrated in FIG. 12, the drive pulse width T1 is corrected to be matched to the average value of the fuel, injection amounts of the fuel injection valves #n to #n+3, so that the control can foe made in a balanced manner without forcedly operating the respective fuel injection valves.

Fourth Example: Method D

Figure 13:
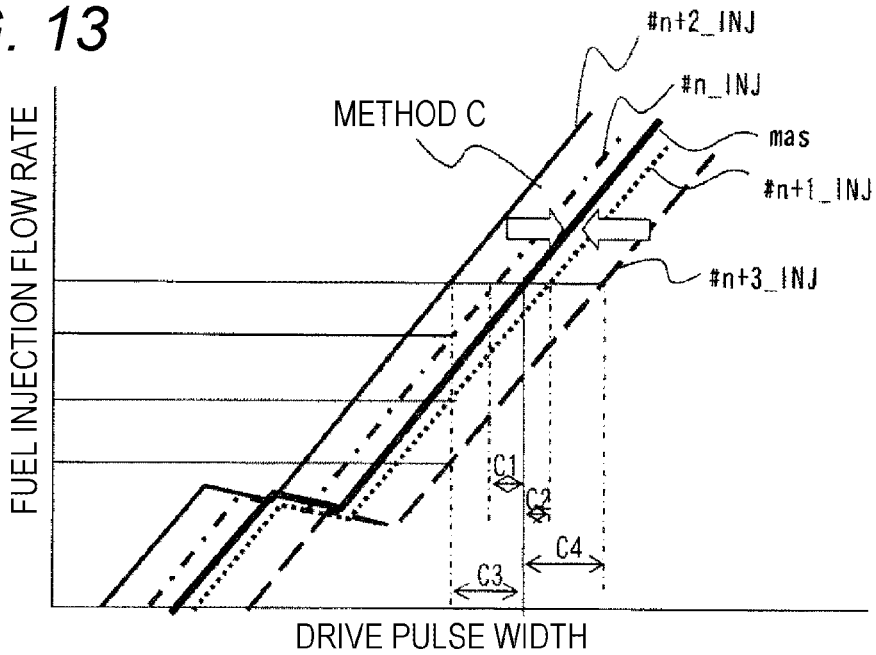
FIG. 13 is a diagram for describing a correction method according to a fourth example.
Figure 14:
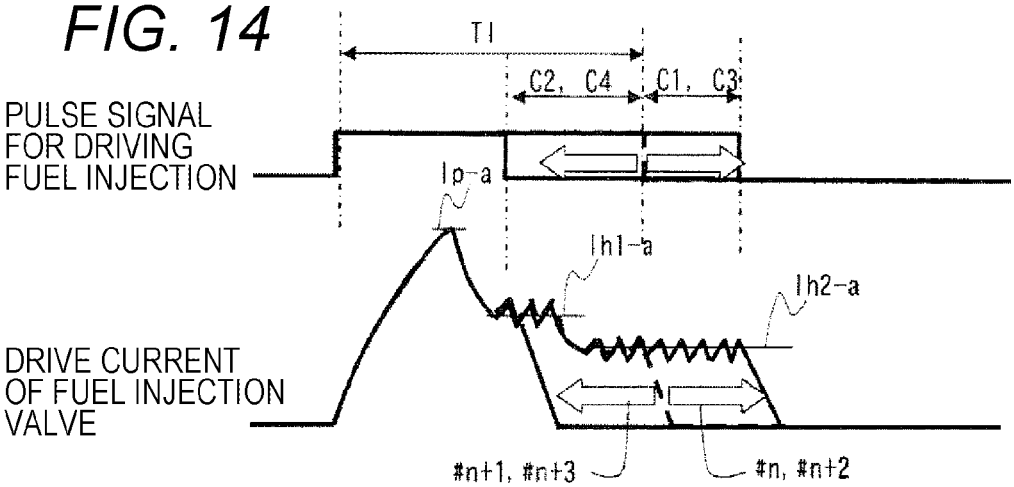
FIG. 14 is a diagram illustrating the corrected drive pulse width in FIG. 13 and the drive current.

FIG. 13 is a diagram for describing a correction method according to a fourth example, and FIG. 14 is a diagram illustrating the corrected drive pulse width in FIG. 13 and the drive current. In the fourth example, a characteristic of a master fuel injection valve which is evaluated in advance is stored in the control device, and the pulse width of the fuel injection valve is corrected to be matched to the character of the master fuel injection valve. Specifically, the pulse widths of the respective fuel injection valves are corrected to be matched to the injection amount mas corresponding to the reference value based on a reference value of the difference between the valve-closing response delay time of the predetermined fuel injection valve and the valve-closing response delay time and a difference between the valve-opening time and the valve-closing response delay time calculated for each fuel injection valve.

Specifically, similarly to the first example, the valve-opening response delay time and the valve-closing response delay time of the fuel injection valve 5 are calculated with respect to the fuel injection, valves #n to #n+3 by the fuel injection valve-closing detection unit (the valve-closing response delay time calculation unit) 9*d*, the fuel injection valve-opening detection unit (the valve-opening response delay time calculation unit) 9*e*. Next, the fuel injection valve-opening/closing calculation unit 9*f* calculates differences (valve-opening response delay time-valve-closing response delay time) Td−Δ−a to Td−Δ−d for the respective fuel injection valves based on the valve-opening response delay times and the valve-closing response delay times of the respective fuel injection valves 5.

Next, the valve-opening response delay time Td−OP−mas and the valve-closing response delay time Td−CL−mas corresponding to the preset drive pulse width TI are read, and a difference Td−Δ−mas between the valve-opening response delay time Td−OP−mas and the valve-closing response delay time Td−CL−mas is calculated. The drive pulse widths of all the fuel injection valves (#n to #n+3) are corrected based on the differences (Td−Δ−a to Td−Δ−d) between the valve-opening response delay times and the valve-closing response delay times of the fuel injection valves and the difference (reference value) Td−Δ−mas. In other words, in this example, differences from the reference value Td−Δ−mas with respect to these differences (Td−Δ−a to Td−Δ−d) become the correction amounts of the respective drive pulse widths.

Specifically, for example, in the case of the fuel injection valves #n and #n+2, the correction amounts C1 and C3 with respect to the drive pulse width TI calculated according to the driving state become differences between Td−Δ−mas, and Td−Δ−a and Td−Δ−c. The drive pulse width TI is corrected based on the correction amounts, and the injection amount approaches the injection amount mas of the fuel injection valve corresponding to the reference value. In the case of the fuel injection valves #n and #n+2, the drive pulse width TI is corrected to be lengthened. On the other hand, in the case of the fuel injection valves #n+1 and #n+3, the correction amounts C2 and C4 with respect to the drive pulse width TI calculated according to the driving state are the differences between Td−Δ−mas-, and Td−Δ−b and Td−Δ−d. The drive pulse width TI is corrected based on the correction amounts, and the injection amount approaches the injection amount mas of the fuel injection valve corresponding to the reference value. In the case of the fuel injection valves #n+1 and #n+3, the drive pulse width TI is corrected to be shortened.

In this way, similarly to the first example, it is possible to increase the accuracy in control of the fuel injection amount of the fuel injection valve by detecting the variation of the parallel shift component of the fuel injection valve to correct the pulse width. In addition, the fuel injection amount is stabilized by correcting the pulse width in correspondence to the variation between the cylinders of the engine, and an air fuel ratio control can be realized with high accuracy.

Furthermore, as illustrated in FIG. 12, the drive pulse width T1 is corrected to make the fuel injection amounts of the fuel injection valves #n to #n+3 matched to the preset fuel injection amount mas, so that the control can be made in a balanced manner without forcedly operating the respective fuel injection valves.

As described above, the drive pulse signal and the fuel injection valve drive current in the drawing are the same as those described in FIGS. 3 and 4. With this regard, in a case where the methods A to D of correcting the drive pulse width according to the first to fourth examples are applied, the injection pulse width may corrected to be lengthened or shortened in Methods C and D according to the third and fourth examples. In the case of Method B of the second example, the correction is limited to that the injection pulse width is shortened, and in the case of Method A of the first example, the correction is limited to that the injection pulse width is shortened.

As described above, in Methods B, C, and D of the second to fourth examples, in a case where the correction is performed to shorten the injection pulse width, the variation and the secular degradation degree of the fuel injection valve are affected. However, in the case of the fuel injection valve of the direct injection type, the fuel injection valve may enter the valve-opening drive current execution region as illustrated in FIG. 3. In this case, the valve-opening current cannot be sufficiently supplied for the fuel injection through the drive pulse width correction, and a sufficient driving force of the fuel injection valve cannot be maintained and thus the valve cannot be opened. However, even in a case where there is no need to control the pulse width for the fuel injection of the engine tip to such a region or in a case where the variation and the secular degradation of the fuel injection valve occur, there is no problem as long as it is possible to previously confirm that the fuel injection valve does not enter the valve-opening current supply region. Therefore, these methods may be applied when it is confirmed that there is no problem in advance.

In addition, in the case of Method D in which the correction is made to be the characteristic of the master fuel injection valve, there is a need to define the master fuel injection valve and to manufacture and evaluate the master fuel injection valve. Further, there is a need to confirm the master performance in the drive circuit of the fuel injection valve. Therefore, the process becomes very difficult for the definition and evaluation. When the master characteristic is defined, the fuel injection control performance and the air fuel ratio control performance of the mass-producing engine can be realized at a safe level.

Through the correction of the pulse width by Methods A to D according to the first to fourth examples, the fuel injection control performance between the cylinders of the engine is improved. However, in a case where the valve-opening response delay time or the valve-closing response delay time of the fuel injection valve is operated at an abnormal value by trouble in the fuel injection valve or the fuel injection valve drive circuit, the characteristic of the abnormal cylinder is also a correction target in a case where the injection pulse width correction is performed by the method according to the invention. Therefore, the drive pulse width correction may be inappropriately performed on the drive pulse width due to an influence of the abnormal cylinder. In this case, the drive pulse width correction is set to be performed when the correction amount of the drive pulse width falls within a range set in advance, and the drive pulse width correction can be restricted only in the case of the correction amount within a desired normal range.

Figure 15:
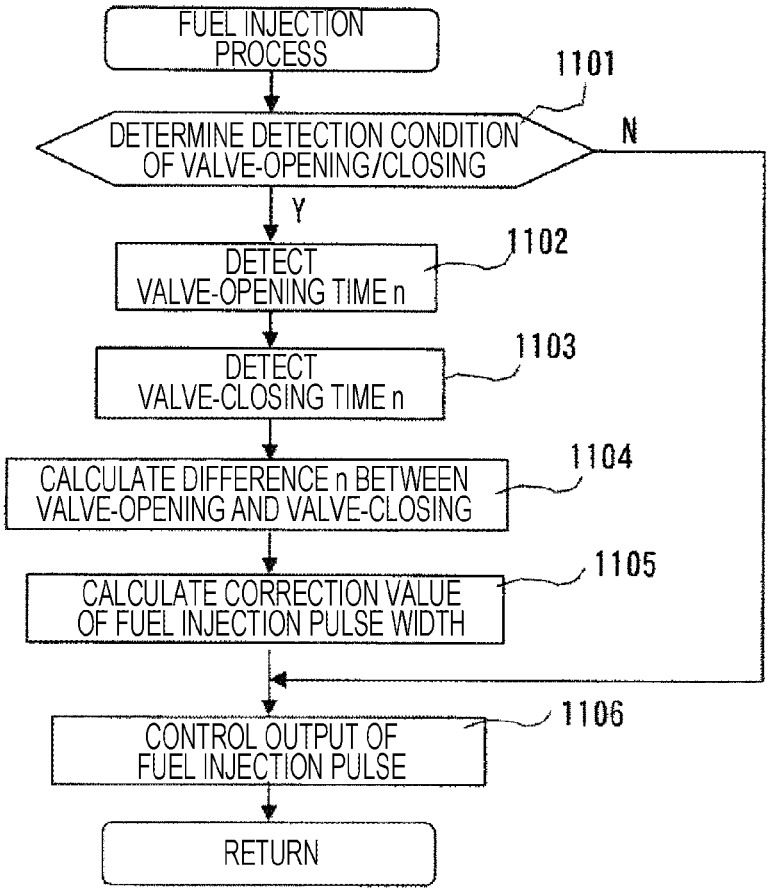
FIG. 15 is a flowchart of control according to the first to fourth examples.

FIG. 15 illustrates a flowchart of the control according to the first to fourth examples. First, a detection condition of the fuel injection valve is determined in Step 1101. In this step, an operation condition of the engine and a failure of the engine may be determined. In a case where it is determined that the condition is satisfied, the valve-opening response delay times of the respective fuel injection valves provided in the engine are detected by the fuel injection valve-opening detection unit (the valve-opening response delay time calculation unit) 9*e* in Step 1102. In Step 1103, the valve-closing response delay times of the respective fuel injection valves are detected by the fuel injection valve-closing detection unit (the valve-closing response delay time calculation unit) 9*d* similarly to the block 1102.

Herein, the average values of the respective fuel injection valves may be obtained when the fuel injections are performed based on the valve-opening response delay times and the valve-closing response delay times of the respective fuel injection valves in Steps 1102 and 1103. Therefore, it is possible to avoid a shot variation for each fuel injection.

In Step 1104, the fuel injection valve-opening/closing calculation unit 9*f* detects the differences, between the valve-opening response delay times and the valve-closing response delay times of the respective fuel injection valves detected in Steps 1102 and 1103. Herein, in the case of Method C according to the third example, the average values of the valve-opening response delay times and the valve-closing response delay times and the difference between the average values are calculated. In the case of Method D according to the fourth example, a reference valve-opening response delay time and a reference valve-closing response delay time, and the difference therebetween are calculated.

In Step 1105, the fuel injection valve pulse width calculation unit 9*b* corrects the drive pulse widths of the fuel injection valves provided in the cylinders of the engine based on the differences between the valve-opening response delay times and the valve-closing response delay times calculated in Step 1104. Herein, the corrections of Methods A to D according to the first to fourth examples may be performed. Next, in Step 1106, the drive pulse widths calculated according to the driving state of the engine are added by the drive pulse widths calculated in Step 1105 so as to perform an injection pulse output control for the cylinders of the engine.

Figure 16:
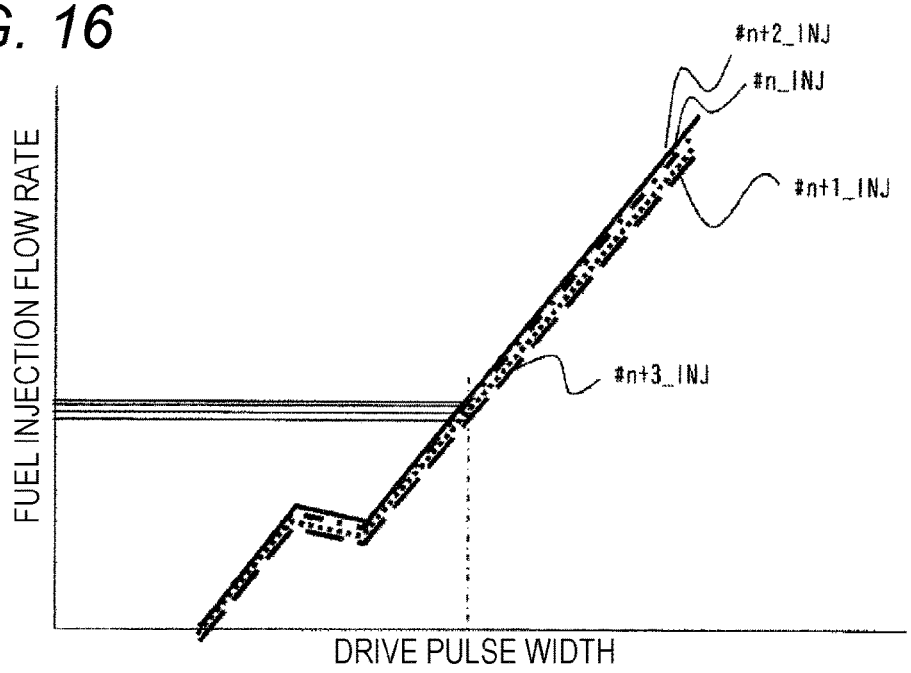
FIG. 16 is a diagram illustrating an example of a fuel injection characteristic effect of an engine according to the first embodiment.

As a result, even in a case where there occurs the variation in manufacturing processes or the secular degradation of the fuel injection valve, it is possible to accurately control the fuel injection in safety. FIG. 16 is a diagram illustrating an example of the fuel injection characteristic effect of the engine according to this embodiment. With the corrections of Methods A to D according to the first to fourth examples, even in a case where there occurs the variation in manufacturing processes or the secular degradation of the fuel injection valves of the cylinders provided in the engine, the fuel pulse widths corrected such that the fuel injection amounts supplied to the cylinders are equal to each other with respect to the same drive pulse widths calculated according to the operation condition. Therefore, the parallel shift component of the variation in the fuel injection amount between the cylinders of the engine is absorbed, and the air fuel ratio control between cylinders is stabilized. Therefore, the variation in the parallel shift component illustrated in FIG. 5 is improved to be the variation difference in the injection amounts between the cylinders illustrated in FIG. 16 (described below with reference to FIG. 17), and the injection amounts of all the cylinders are controlled to be a desired air fuel ratio through the air fuel feedback control performed in the related art.

Figure 17:
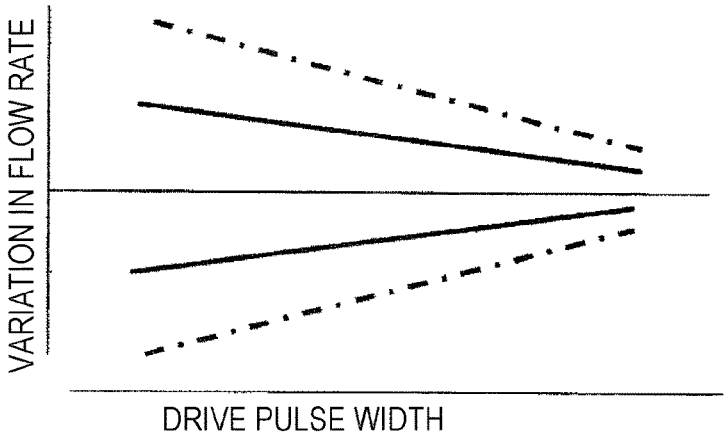
FIG. 17 is a diagram illustrating an example of a fuel injection characteristic variation effect of the engine when the correction method according to the first embodiment is employed.

FIG. 17 is a diagram illustrating an example of a fuel injection characteristic variation effect of the engine when the correction method according to this embodiment is employed. In FIG. 17, the horizontal axis represents a drive pulse width (a fuel injection pulse width), and the vertical axis represents a variation width of the fuel injection valve provided in the engine. The parallel shift component of the fuel injection valve is absorbed between the cylinders by correcting the drive pulse width (the solid line shows that the drive pulse width correction according to this embodiment is performed, and the chain line shows that the drive pulse width correction according to this embodiment is not performed), and the fuel injection amount control can be accurately performed between the cylinders.

Figure 18:
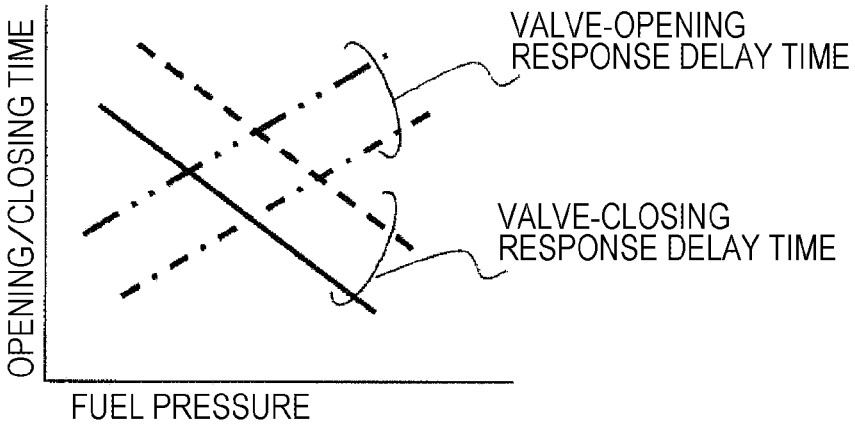
FIG. 18 is a diagram illustrating characteristics of the valve-opening response delay time and the valve-closing response delay time of the fuel injection valve according to the first embodiment.

FIG. 18 is a diagram illustrating the characteristics of the valve-opening response delay time and the valve-closing response delay time of the fuel injection valve according to this embodiment (the first to fourth examples). As described above, in this embodiment, the valve-opening response delay times and the valve-closing response delay times of the fuel injection valves are detected, and the pulse width correction between the cylinders is performed on the fuel injection valve provided in the engine. The differences between the valve-opening response delay times and the valve-closing response delay times of the fuel injection valves are compared, and then a relation of the fuel pressure of the engine with respect to the valve-opening response delay times and the valve-closing response delay times will be described below.

The valve-opening response delay time and the valve-closing response delay time of the fuel injection valve are roughly determined by the spring set load in the fuel injection valve, the magnetic force for driving the fuel injection valve, and the fuel pressure added to the fuel injection valve as described with reference to FIG. 3. Among them, in a case where the fuel pressure supplied to the fuel injection valve is changed, the valve-opening response delay time (the two-dotted chain line in the drawing) of the fuel injection valve is changed, and the delay is increased as the fuel pressure is increased. The valve-closing response delay times (the solid line and the dotted line in the drawing) are shortened as the fuel pressure is increased. In the relation with respect to the fuel pressure, the relative variation between the valve-opening response delay time and the valve-closing response delay time is maintained (not changed) even in a case where the fuel pressure is changed. For this reason, the valve-opening variation and the valve-closing variation of the fuel injection valve may foe detected in the fuel pressure state on a desired operation condition (it is desirable that the determination be performed on a small pulsation of the fuel pressure). The drive pulse width correction described in the first to fourth examples may be performed based on the information of the detected valve-opening response delay time and the detected valve-closing response delay time. Therefore, there is no need to perform the detection and the correction for every operation condition and every state of the fuel pressure, so that it is possible to perform the correction control of the drive pulse width through a simply method.

In addition, the correction of the drive pulse width can be restricted in more safety in a case where the restriction is set for each fuel pressure. Specifically, the pulse width correction unit may restrict (forbid) the correction of the drive pulse width based on the pressure of the fuel supplied to the fuel injection valve. In other words, even in a case where the fuel pressure is changed, the variation in the valve-opening response delay time and the valve-closing response delay time of the fuel injection valve is maintained in magnitude. However, a case where the drive circuit of the fuel injection valve or the fuel injection valve has trouble does not correspond to the above case. Therefore, the correction is more stably restricted by setting a restriction on the correction of the drive pulse width according to the fuel pressure for each range of the fuel pressure.

Hitherto, the description has been made about that the drive pulse width of the internal combustion engine is corrected by detecting the valve-opening timing and the valve-closing timing of the fuel injection valve. As a method of detecting the variation in the fuel injection amount of the fuel injection valve provided in the internal combustion engine, the correction may be perforated based on the information of the air fuel ration sensor (13 of FIG. 1) provided in the exhaust pipe of the internal combustion engine, and the same effect can be achieved. Hereinafter, the method will be described.

Second Embodiment

Figure 19:
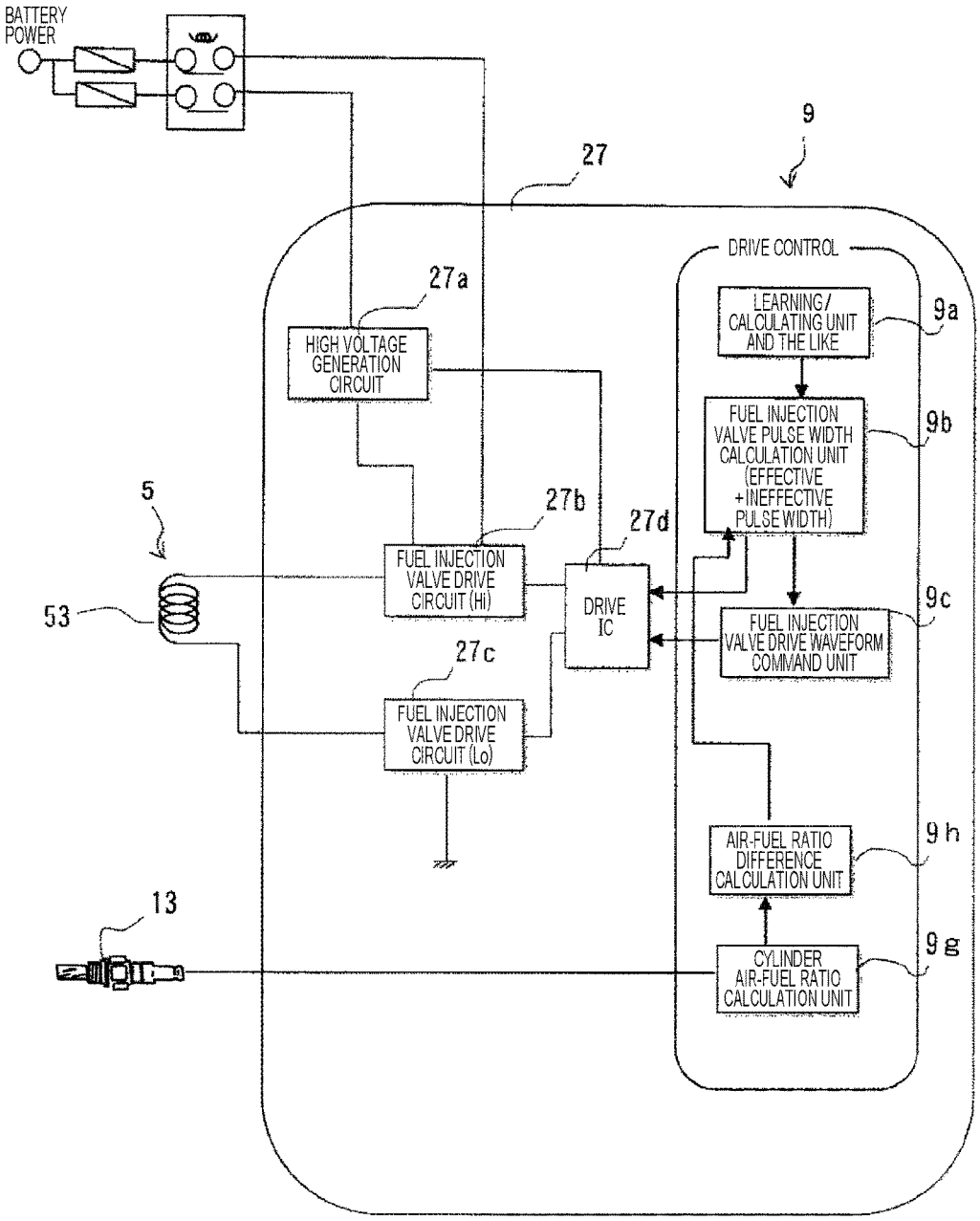
FIG. 19 is a diagram illustrating a configuration of a fuel injection control device according to a second embodiment.

FIG. 19 is a diagram illustrating a configuration of a fuel injection control device according to a second embodiment. The fuel injection control device according to the second embodiment is different from the control device according to the first embodiment in that a cylinder air-fuel ratio calculation unit 9*g* and an air-fuel ratio difference calculation unit 9*h* are newly provided instead of the fuel injection valve-closing detection unit (the valve-closing response delay time calculation unit) 9*d*, the fuel injection valve-opening detection unit (the valve-opening response delay time calculation unit) 9*e*, and the fuel injection valve-opening/closing calculation unit 9*f*, and thus the description of the other configurations will not be repeated.

As illustrated in FIG. 19, the cylinder air-fuel ratio calculation unit 9*g* detects the air fuel ratio for each cylinder based on the result of the fuel injected to the cylinder. As a method of detecting the air fuel ratio for each cylinder, the method disclosed in JP 2013-2475 A (a document of the related art) may be employed for example. Herein, the method of detecting the air fuel ratio for each cylinder is not directly related to the invention, and thus the description will be omitted.

The air-fuel ratio difference calculation unit 9*h* calculates a difference (an air-fuel ratio difference) in the exhaust air-fuel detected between the cylinders. For example, in the case of four cylinders, six air-fuel ratio combinations are calculated. Next, the fuel injection valve pulse width calculation unit 9*b* selects a reference fuel injection valve from among a plurality of fuel injection valves based on an air-fuel ratio difference, and corrects the drive pulse widths of the other fuel injection valves to be matched to the air fuel ratio of the selected fuel injection valve (the pulse width correction unit).

For example, in Method A, the fuel, injection valve of which the detected exhaust air-fuel ratio is large in two fuel injection valves having the largest air-fuel ratio difference is selected as the reference fuel injection valve, and the drive pulse width of the other fuel injection valve are corrected to be matched to the air fuel ratio of the fuel injection valve. On the other hand, in Method B, the fuel injection valve of which the detected exhaust air-fuel ratio is small in two fuel injection valves having the largest air-fuel ratio difference is selected as the reference fuel injection valve, and the drive pulse width of the other fuel injection valve are corrected in matched to the air fuel ratio of the fuel injection valve. In Method C, the average value of all the detected exhaust air-fuel ratios is calculated, and the drive pulse widths of all the fuel injection valves are corrected to approach the air fuel ratio of the average value. The correction amount at this time corresponds to the air-fuel ratio difference, and a correspondence relation between a change amount of the air fuel ratio and a change amount of the drive pulse width may be experimentally inspected in advance to determine the correction amount from the correspondence relation.

From the above description, Methods A to C are expected to have the corresponding same effects as Methods A to C based on the valve-opening response delay time and the valve-closing response delay time of the fuel injection valve in the first embodiment.

Figure 20:
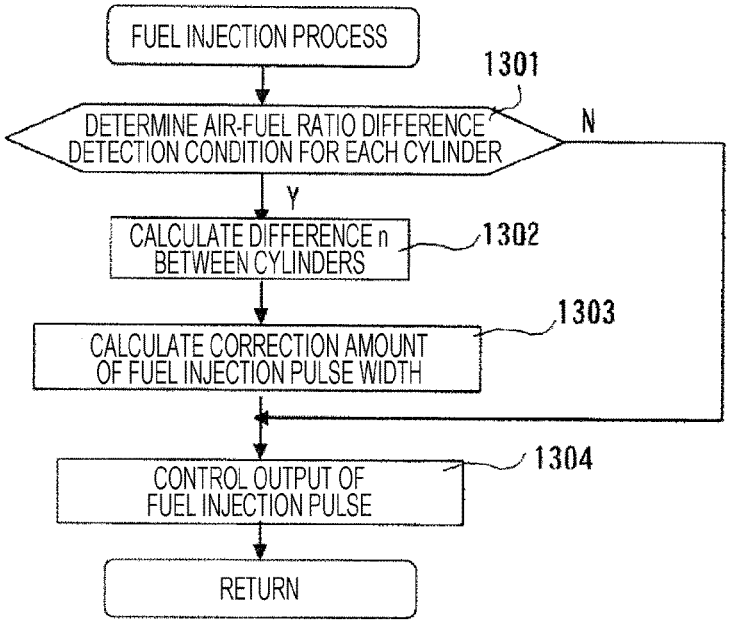
FIG. 20 is a flowchart of control according to the second embodiment.

FIG. 20 is a flowchart of the control according to the second embodiment. In Step 1301, an air-fuel ratio difference detection condition is determined for each cylinder of the engine. Similarly to FIG. 15, the operation condition of the engine and the failure determination of the engine may be performed. In a case where the condition is satisfied as a result of the subject determination, the process proceeds to Step 1302.

In Step 1302, the air-fuel ratio difference calculation unit 9*h* calculates the air-fuel ratio difference between the respective cylinders of the engine. The average values of the respective fuel injection valves may be obtained when the fuel injections are performed based on the air-fuel ratio difference between the respective cylinders. Therefore, it is possible to avoid a shot variation for each fuel injection.

In Step 1303, in the case of Methods A and 33, the reference fuel injection valve is selected from among the plurality of fuel injection valves based on the air-fuel ratio difference, and the correction amounts of the drive pulse widths of the other fuel injection valves are calculated to be matched to the exhaust air fuel ratio of the selected fuel injection valve. In the case of Method C, the average value of the exhaust air-fuel ratio is calculated, and the corrections amounts of the drive pulse widths of all the fuel injection valves are calculated to be matched to the average value.

In Step 1304, the correction amount calculated in Step 1303 is added to the drive pulse width calculated according to the driving state of the engine illustrated in FIG. 15, and the injection pulse output control is performed for each cylinder of the engine.

Figure 21:
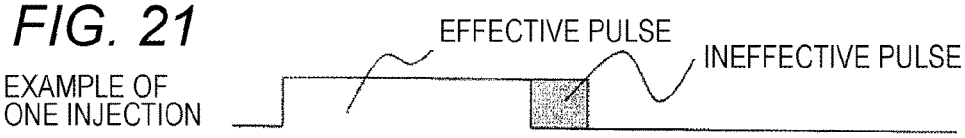
FIG. 21 is a diagram for describing a method of controlling a pulse width of the fuel injection valve according to the first and second embodiments.

FIG. 21 is a diagram for describing a method of controlling the pulse width of the fuel injection valve according to the first and second embodiments. In general, in the pulse width control of the fuel injection valve, an effective pulse width and an ineffective pulse width are obtained, and both the pulse widths are added and the output of the fuel injection valve is performed. Herein, the effective pulse width is a pulse width in which the fuel injection is actually performed, and the ineffective pulse width corresponds to the valve-opening response portion and the valve-closing response portion of the fuel injection valve with respect to the drive pulse width, and is well known in the related art.

Figure 22:
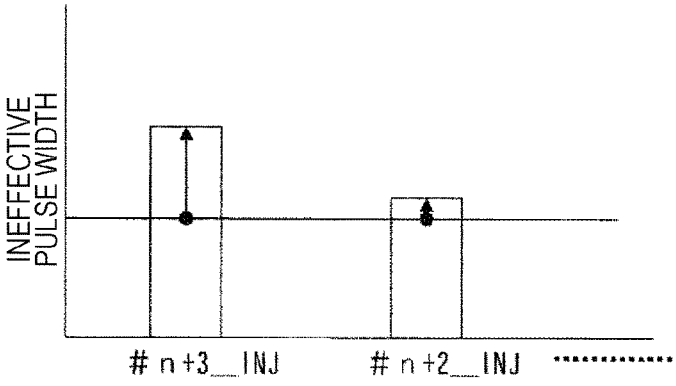
FIG. 22 is a diagram for describing a method of correcting the drive pulse width according to the first and second embodiments.

FIG. 22 is a diagram for describing a method of correcting the drive pulse width according to the first and second embodiments. In this embodiment, the parallel shift component is absorbed by correcting the variation in the valve-opening response delay time and the valve-closing response delay time of the fuel injection valve, so that it is possible to improve the accuracy of the fuel injection. Therefore, the correction amount of the drive pulse width actually corresponds to the ineffective pulse width illustrated in FIG. 21. The ineffective pulse widths of the fuel injection valves illustrated in FIGS. 4 and 5 have the characteristic illustrated in FIG. 22, and the ineffective pulse width may be corrected as depicted by the arrows in the drawing.

Hitherto, the correction of the drive pulse width described in the first and second embodiments is performed on the ineffective pulse width instead of the effective pulse width, so that the correction can be stably performed over the entire drive area of the engine, the fuel injection control and the air fuel ratio control can be accurately performed.

In addition, since there occurs no steep change in the variation and the secular degradation of a target fuel injection valve, it is desirable that the correction of the drive pulse width store the pulse width as a learning value in a non-volatile storage such as a buffer RAM or an EEP-ROM, and update the value during a lifespan of the engine so as to correct the drive pulse width.

Hitherto, the description has been made about the invention. According to the invention, the fuel injection amount can be more accurately controlled by detecting and correcting the variation and the degradation of the fuel injection valve provided in the engine. As a result, it is possible to avoid an exhaust emission and a drive deterioration of the engine while providing a safe air fuel ratio control of the engine.

Hitherto, the description has been made about the embodiments of the invention, and the invention is not limited to the embodiments. Various changes in design can foe made in a scope not departing from the spirit of the invention denoted in claims.

For example, in this embodiment, the correction amount of the fuel pulse width is calculated based on both of the valve-opening response delay time and the valve-closing response delay time, but in a case where the variation is mainly caused from the spring force provided in the fuel injection valve, the correction amount of the subject fuel pulse width can be easily calculated only by calculating any one of the valve response delay times.

REFERENCE SIGNS LIST

1 engine
2 piston
3 intake valve
4 exhaust valve
5 fuel injection valve
6 ignition plug
7 ignition coil
8 water temperature sensor
9 ECU (engine control unit)
9*a* learning/calculating unit
9*b* fuel injection valve pulse width calculation unit
9*c* fuel injection valve drive waveform command unit
9*d* fuel injection valve-closing detection unit (valve-closing response delay time calculation unit)
9*e* fuel injection valve-opening detection unit (valve-opening response delay time calculation unit)
9*f* fuel injection valve-opening/closing calculation unit
9*g* cylinder air-fuel ratio calculation unit
9*h* air-fuel ratio difference calculation unit
10 intake pipe
11 exhaust pipe
12 three-way catalyst
13 oxygen sensor
14 EGR valve
15 collector
16 crank angle sensor
18 EGR passage
19 throttle
20 AFM
21 combustion chamber
22 accelerator opening sensor
23 fuel tank
24 low pressure fuel pump
25 high pressure fuel pump
26 fuel pressure sensor
27 fuel injection control device
27*a* high voltage generation circuit
27*b* fuel injection valve drive circuit
27*c* fuel injection valve drive circuit
27*d* drive IC

The invention claimed is:

1. An electronic controller of an internal combustion engine that is provided with a plurality of fuel injection valves configured to respectively supply fuel to a plurality of cylinders, wherein the electronic controller is configured to:

determine respective drive pulse widths for a plurality of drive pulse signals configured to respectively drive the plurality of fuel injection valves for injecting the fuel according to a driving state of the internal combustion engine;

determine valve-opening response delay times and valve-closing response delay times with respect to the drive pulse signals, and determine respective differences between the valve-opening response delay times and the valve-closing response delay times;

select a reference fuel injection valve from among the plurality of fuel injection valves based on the valve-opening response delay times and the valve-closing response delay times calculated for the fuel injection valves;

determine the drive pulse width for the drive pulse signal for the reference fuel injection valve based on the difference between the valve-opening response delay time and the valve-closing response delay time corresponding to the reference fuel injection valve;

determine the respective drive pulse widths for the drive pulse signals for the other fuel injection valves of the plurality of fuel injection valves based on (i) the difference between the valve-opening response delay time and the valve-closing response delay time corresponding to the reference fuel injection valve, and (ii) the respective other differences between the valve-opening response delay times and the valve-closing response delay times; and transmit at least one of the drive pulse signals having a respective one of the determined drive pulse widths to a valve control circuit.

2. The electronic controller according to claim 1, wherein the electronic controller is configured to select the fuel injection valve of the plurality of fuel injection valves which has a smallest difference between the valve-opening response delay time and the valve-closing response delay time as the reference fuel injection valve.

3. The electronic controller according to claim 1, wherein the electronic controller is configured to select the fuel injection valve of the plurality of fuel injection valves which has a largest difference between the valve-opening response delay time and the valve-closing response delay time as the reference fuel injection valve.

4. An electronic controller of an internal combustion engine that is provided with a plurality of fuel injection valves configured to respectively supply fuel to a plurality of cylinders, wherein the electronic controller is configured to:

determine respective drive pulse widths for a plurality of drive pulse signals configured to respectively drive the plurality of fuel injection valves for injecting the fuel according to a driving state of the internal combustion engine;

determine valve-opening response delay times and valve-closing response delay times with respect to the drive pulse signals, and determine respective differences between the valve-opening response delay times and the valve-closing response delay times;

determine an average value of a difference between the valve-closing response delay times and the valve-closing response delay times for the plurality of fuel injection valves, and determine a reference pulse width based on the average value;

determine the respective drive pulse widths for the plurality of drive pulse signals based on the reference pulse width; and transmit at least one of the drive pulse signals having a respective one of the determined drive pulse widths to a valve control circuit.

* * * * *